US005263281A

United States Patent [19]

Osborn

[11] Patent Number: 5,263,281

[45] Date of Patent: Nov. 23, 1993

[54] VERTICALLY PIVOTAL SECURITY GATE

[75] Inventor: Robert J. Osborn, Merced, Calif.

[73] Assignee: Sun Power Security Gates Inc., Merced, Calif.

[21] Appl. No.: 958,225

[22] Filed: Oct. 8, 1992

[51] Int. Cl.[5] ..... E05F 15/00

[52] U.S. Cl. ..... 49/280; 49/49; 49/302; 49/340; 49/385

[58] Field of Search ..... 49/280, 279, 300, 302, 49/340, 385, 49

[56] References Cited

U.S. PATENT DOCUMENTS

| | | | |
|---|---|---|---|
| 1,914,359 | 6/1933 | Butts | 49/280 X |
| 4,457,105 | 7/1984 | Danin | 49/49 |
| 4,495,730 | 1/1985 | Kennedy | 49/280 |
| 4,658,543 | 4/1987 | Carr | 49/340 X |
| 4,779,379 | 10/1988 | Steen | 49/385 |
| 4,887,205 | 12/1989 | Chou | 49/280 X |
| 4,887,393 | 12/1989 | Cysewski | 49/385 |
| 4,986,031 | 1/1991 | Agnew et al. | 49/385 |

OTHER PUBLICATIONS

"Welcome to Sun Power security gates".

*Primary Examiner*—Philip C. Kannan
*Attorney, Agent, or Firm*—Gordon L. Peterson

[57] ABSTRACT

A security gate system including a supporting structure and a gate mounted on the supporting structure for pivotal movement about a generally horizontal pivot axis between a closed position and an open position. A drive wheel is rotatably mounted on the supporting structure and is drivingly coupled to the gate so that rotation of the drive wheel in a gate opening direction drives the gate from the closed position to the open position. A first motor drives the drive wheel and a releasable lock releasably holds the drive wheel against rotation in the gate opening direction. A second motor moves a locking member of the releasable lock to a releasing position to allow the gate to be moved to the open position. The gate system may include two of the gates having operators sharing the same supporting structure.

10 Claims, 4 Drawing Sheets

VERTICALLY PIVOTAL SECURITY GATE

BACKGROUND OF THE INVENTION

Security gates are commonly used for various purposes including controlling ingress and egress to residential communities, businesses, and ranch roads. These gates are operated in a variety of ways such as push button digital combinations, remote push buttons, key card reader system, intercom of telephone system, air hose switch, ground loop sensory system, hand-held transmitters, etc., all of which generate a gate opening signal. Gate closure can occur after a predetermined time delay or in response to a gate closure- signal which can be generated in any suitable manner such as by one of the above mentioned systems.

Security gates of this type commonly move horizontally between the open and closed positions. One prior art security gate system of this type includes a gate which pivots about a generally vertical pivot axis between the open and closed positions. However, a gate of this type cannot effectively be used on sloping terrain, and there is a tendency for some vehicle drivers to try to hasten the opening of the gate by pushing on it with their vehicle, and this can damage the gate and its operating mechanism.

Another prior art security gate system employs a gate which is moved linearly between the open and closed positions. This gate system, however, requires substantial space to the side of the roadway for movement of the gate and is more difficult to install and/or use on sloped terrain.

A security gate system utilizing a vertically moveable gate overcomes these disadvantages. In a gate system of this type, the gate is mounted on a supporting structure for pivotal movement about a generally horizontal pivot axis between closed and open positions. Because the gate pivots in a vertical plane, it can be used regardless of the sloping nature of the route or roadway across which the gate extends in the closed position. Also, because the gate pivots vertically there is no need for a large space adjacent the route or roadway for receiving the gate in the open position.

One problem with vertical gate systems is in locking them in the closed position so they are more difficult to open by unauthorized personnel. In this regard, it may be possible for the locking mechanism, which holds the gate in the closed position, to be back driven or unlocked by jiggling the gate. Of course, to the extent that the security gate can be opened by unauthorized personnel, it does not serve its primary function of providing security.

More specifically, one prior art vertical gate system employs a releasable lock for use in releasably holding the gate in a closed position. The lock is movable between a locking position and a releasing position with such movement being brought about by a belt-driven mechanism. Overall, the vertical gate system operates quite well. However, it has been found that the belt drive is subject to being back driven by jiggling the gate, and this can unlock the gate to allow unauthorized personnel to open the gate. This belt is also used to drive the gate between the closed and open positions. It has been found that this belt tends to stretch with use, and this can cause a failure of the releasable lock to release quickly enough with the result that the gate hangs up or fails to open.

In many instances, the incoming and outgoing roads to a community are side by side. In this event, one vertical gate can be used to control ingress and a second vertical gate can be used to control egress. The operating mechanism for each of these two gates can advantageously be provided between the two roadways. However, it has been found that placing two of the supporting structures for the operating mechanisms of two gates in side-by-side relationship in many cases takes more space than is desired.

SUMMARY OF THE INVENTION

This invention provides a security gate system which makes it more difficult for unauthorized personnel to unlock the gate and operate it. Accordingly, the security afforded by the security gate system of this invention is enhanced. In addition, this invention provides a security gate system which includes two of the vertical gates having their operating mechanisms sharing a common supporting structure and housing thereby reducing the space required.

According to one feature of this invention, a first motor is used to drive the gate from the closed position to the open position and a second motor is provided for moving the locking member from the locking position to the releasing position. The second motor cannot be back driven by jiggling of the gate or any other exposed component of the security gate system, and it provides a more secure releasing mechanism than the belt drive the prior art. The second motor is not subject to slowing down with use and therefore is certain to provide unlocking or releasing of the releasable lock quickly enough to prevent stalling or failure of the gate to be moved to the open position.

Although the second motor can be of various different kinds, a solenoid is preferred. A solenoid is relatively inexpensive and fast acting so that rapid unlocking of the releasable lock is assured. A simple linear solenoid is preferred.

Another feature of this invention is to utilize an arm coupled to the releasable lock and means for driving the arm so as to move the locking member from the locking position to the releasing position. This driving means may be, and preferably is, the second motor described above. However, this driving means may be an appropriate power take off from the first motor, i.e. the motor used to move the gate from the closed position to the open position. If a power take off is used, it is preferably one which provides a fixed drive ratio or relationship and one which does not allow slippage in the drive connections between the motor and the arm. This also improves the prior art belt drive.

In a preferred construction, the locking member is pivotally mounted on the supporting structure between the locking and releasing positions. A drive wheel is rotatably mounted on the supporting structure and is drivingly coupled to the gate so that rotation of the drive wheel in a gate opening direction drives the gate from the closed position to the open position. The releasable lock can advantageously include a stop carried by the drive wheel, and preferably the locking member is pivotally mounted on the supporting structure for movement between the locking and releasing position. The locking member is cooperable with the stop in the locking position to hold the drive wheel against significant rotation in the gate-raising direction.

Another feature of this invention is that the locking member preferably has a generally flat end surface facing the stop in the locking position. This can be contrasted with a pointed end on the prior art locking member. In the prior art belt drive construction, the pointed end was necessary so that even a slight movement of the locking member would achieve releasing of the drive wheel sufficiently rapidly so that the drive wheel would not "hang up" and prevent the gate from being moved to the open position. However, the pointed end also made it easier to unlock the gate by jiggling the gate. With the present invention, the positive action achieved in the unlocking movement of the locking member enables the end surface facing the stop to be generally flat. Accordingly, any vibrations or jiggling of the gate that might impart slight angular motion to the drive wheel will be insufficient to release the drive wheel for rotation.

This invention also provides a vertical gate system which includes first and second vertical gates. The space required for the security gate system is reduced by utilizing one housing to substantially enclose a supporting structure for both of the vertical gates. The single housing is narrower and therefore requires less space than two of the housings placed side by side. Also, the single housing enables a component of the mounting structure or operating mechanism for the first vertical gate to overlap as viewed from above a component of the mounting structure or operating mechanism for the second gate. Also, a single battery within the housing can be used to provide power for both of the operating mechanisms and only a single control panel can be utilized for both gates.

The invention, together with additional features and advantages thereof may best be understood by reference to the following description taken in connection with the accompanying illustrative drawings.

DESCRIPTION OF THE PREFERRED EMBODIMENTS

Figure 1:
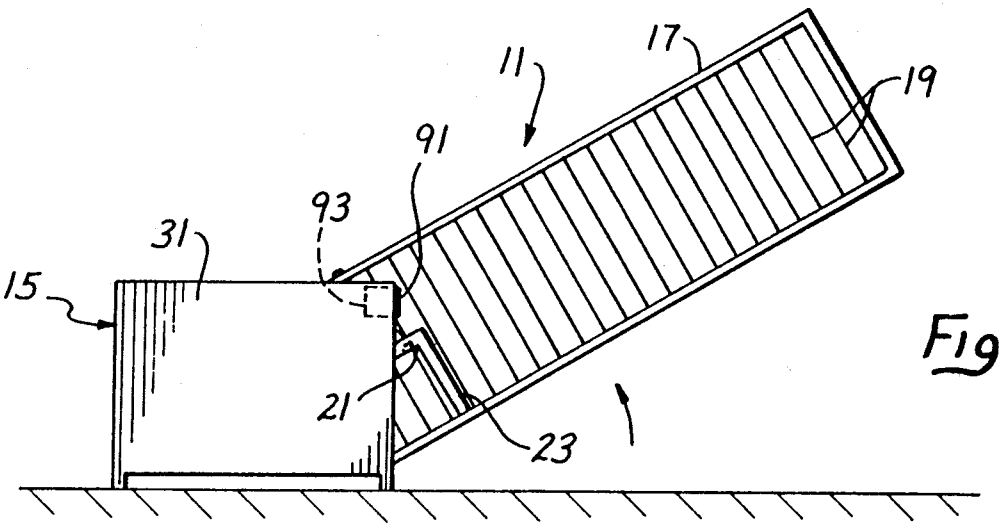
FIG. 1 is a front elevational view of a security gate system constructed in accordance with the teachings of this invention with the gate being raised to the open position.
Figure 4:
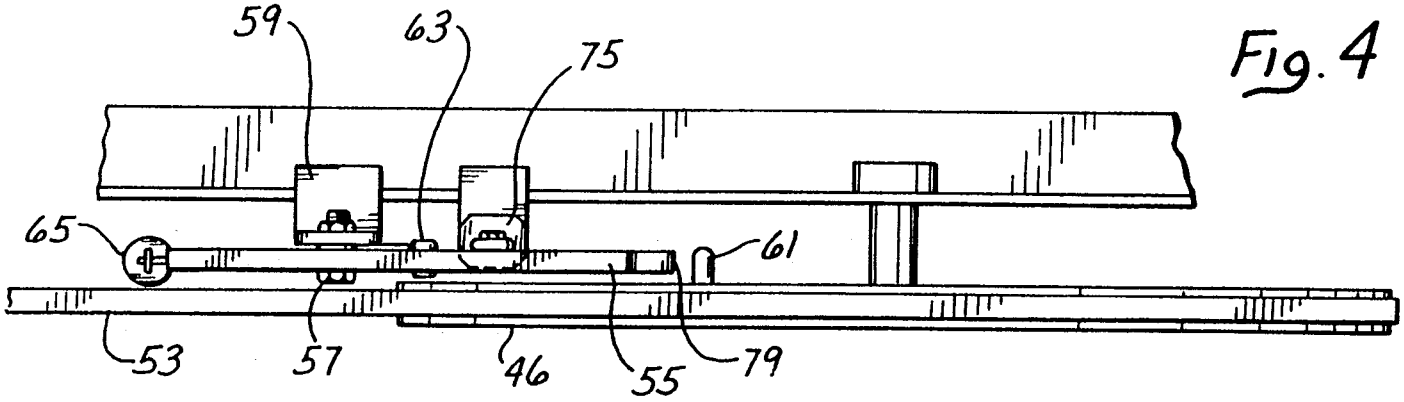
FIG. 4 is a fragmentary top plan view of a portion of the structure for raising and lowering the gate with the housing removed.

FIG. 1 shows a security gate system 11 which generally includes a gate 13 and a supporting structure 15. The gate 13 may be a conventional metal gate comprising a peripheral frame 17 and parallel vertical bars 19. The gate 13 also includes a mounting member 21 and a mounting member support 23 (FIGS. 2 and 3) joined to the peripheral frame 17 and a mounting post 25 pivotally attached to the supporting structure 15 by a pin 27 in a conventional manner for vertical gates. This mounts the gate 13 on the supporting structure 15 for pivotal movement about a generally horizontal pivot axis, which is defined by the pin 27, between a closed position (FIG. 2) in which the gate can block traffic along a predetermined route and an open position in which the gate is pivoted upwardly from the closed position sufficiently to allow traffic to move along the predetermined route. In the open position, the gate 13 may extend, for example, vertically upwardly.

The supporting structure 15 includes a frame 29 (FIGS. 2 and 3) and a housing 31 (FIG. 1) encasing the frame and having an opening (not shown) to receive the gate. The frame 29 includes vertical end posts 33 interconnected by upper and lower horizontal frame members 35 and 37 which are in turn supported intermediate their ends by an intermediate post 39. Parallel horizontal frame members 41 extend between one of the end posts 33 and the intermediate post 39 and a mounting plate 43 is fixedly attached to the frame members 41.

Figure 2:
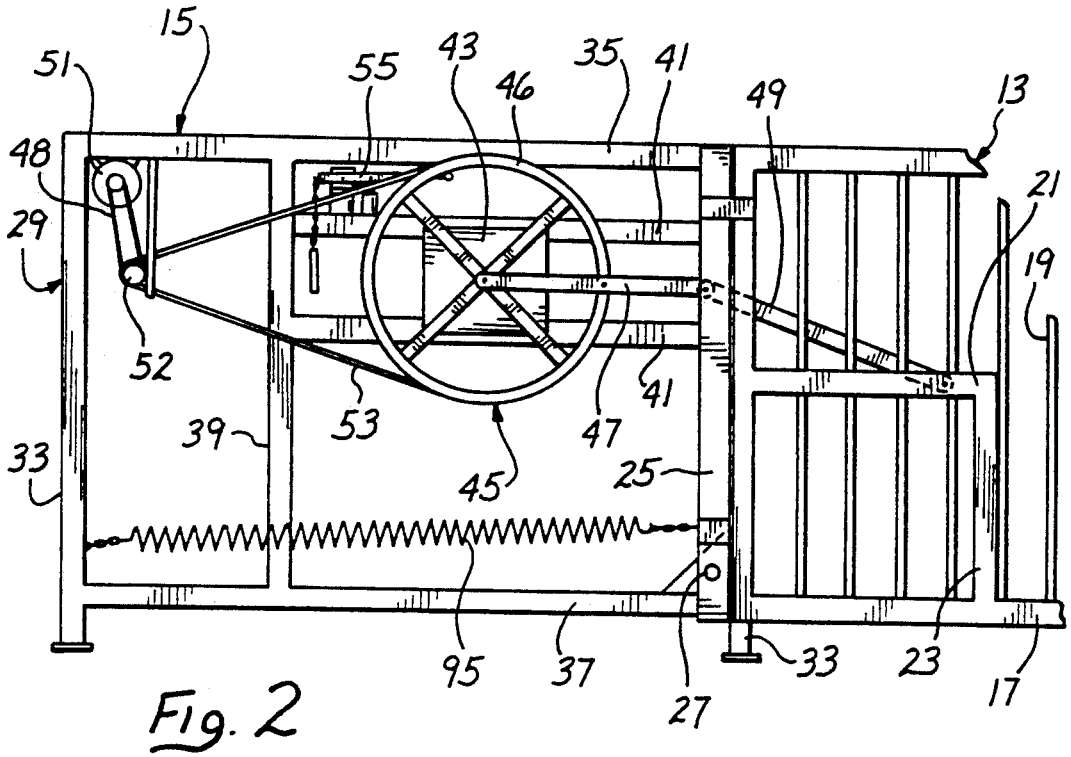
FIGS. 2 and 3 are fragmentary front elevational views with the front of the housing removed showing the gate in the closed and partially open positions, respectively.
Figure 3:
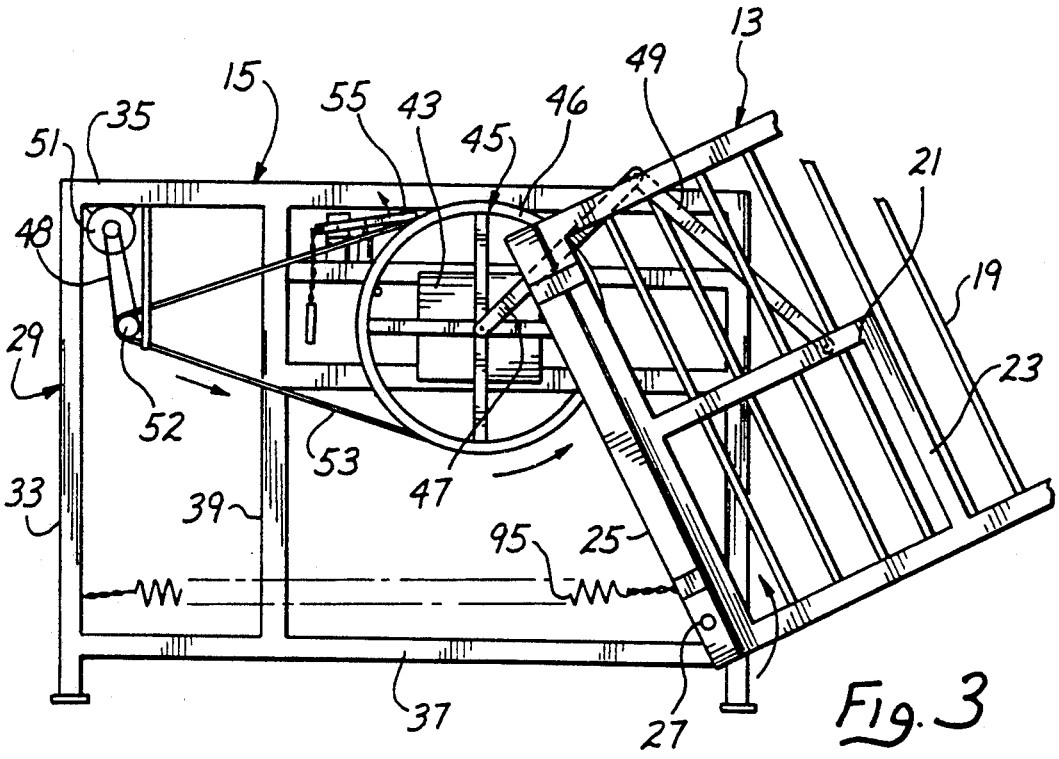

A drive wheel 45 having a peripheral band 46 is rotatably mounted on the mounting plate 43 of the supporting structure 15 and is drivingly coupled to the gate 13 by a lever 47 and a link 49 (FIGS. 2 and 3). The lever 47 is affixed to the center and periphery of the drive wheel 45 and the link 49 is pivotally coupled at its outer ends to the mounting member 21 of the gate 13 and to the outer end of the lever 47. Accordingly, rotation of the drive wheel 45 in a gate opening direction, i.e. counterclockwise as viewed in FIGS. 2 and 3, drives the gate 13 from the closed position of FIG. 2 to the open position.

A reversible motor 51 is suitably mounted on the supporting structure 15 and is drivingly coupled to the drive wheel 45 by, for example, a belt 48, a gear reduction assembly 52 and an endless belt 53 so that energization of the motor in a first direction rotates the drive wheel in the gate opening direction.

A releasable lock is provided for releasably holding the drive wheel 45 against rotation in the gate opening direction so that the gate 13 is held in the closed position. The releasable lock includes a locking member 55 (FIG. 5) pivotally attached as by a pin 57 to a mounting member 59 of the supporting structure 15. The mounting member 59 may be suitably affixed to one of the frame members 41. The releasable lock also includes a stop 61 carried by the drive wheel 45. Although various different constructions can be employed, in this embodiment, the stop 61 is a pin suitably affixed as by welding to the inner periphery of the band 46 of the drive wheel 45.

Figure 5:
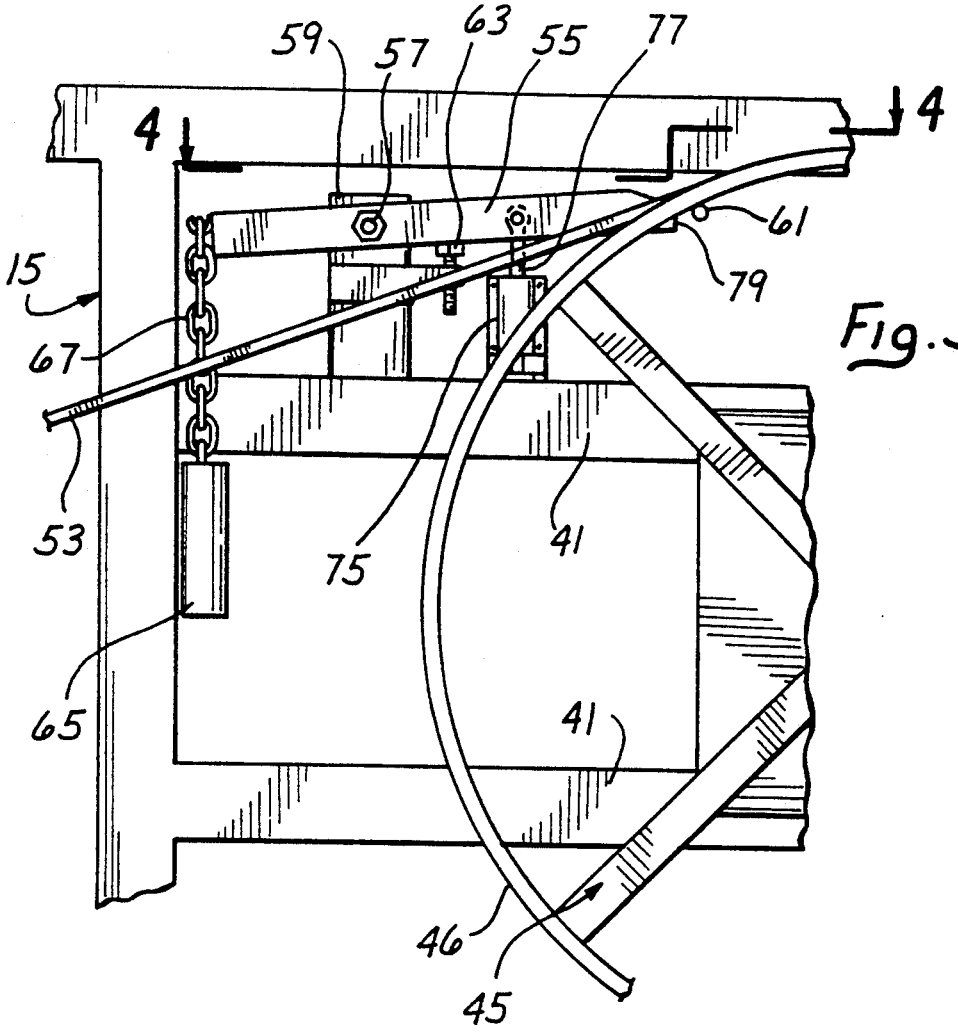
FIG. 5 is an enlarged fragmentary front elevational view showing a portion of the drive wheel and the releasable lock of this invention.

The locking member 55 can be pivoted about the pin 57 between a locking position shown in FIG. 5 in which the locking member cooperates with the stop to hold the drive wheel against significant rotation in the gate opening direction and a releasing position (FIG. 3) in which the stop 61 passes beneath the locking member 55 to allow the drive wheel to be driven in the gate opening direction. As viewed in FIG. 5, the locking member 55 is movable counterclockwise about the pin 57 from the locking position to the releasing position. The precise angular location of the locking member 55 about the pin 57 in the locking position can be determined by an adjustable abutment 63 on which the locking member 55 rests in the locking position. In this embodiment, the abutment 63 is the top surface of a screw threaded into a portion of the mounting member 59. To assist rapid movement of the locking member 55 from the locking position to the releasing position, a weight 65 is attached to the left end (as viewed in FIG. 5) of the locking member in any suitable manner such as by a chain 67.

Figure 6:
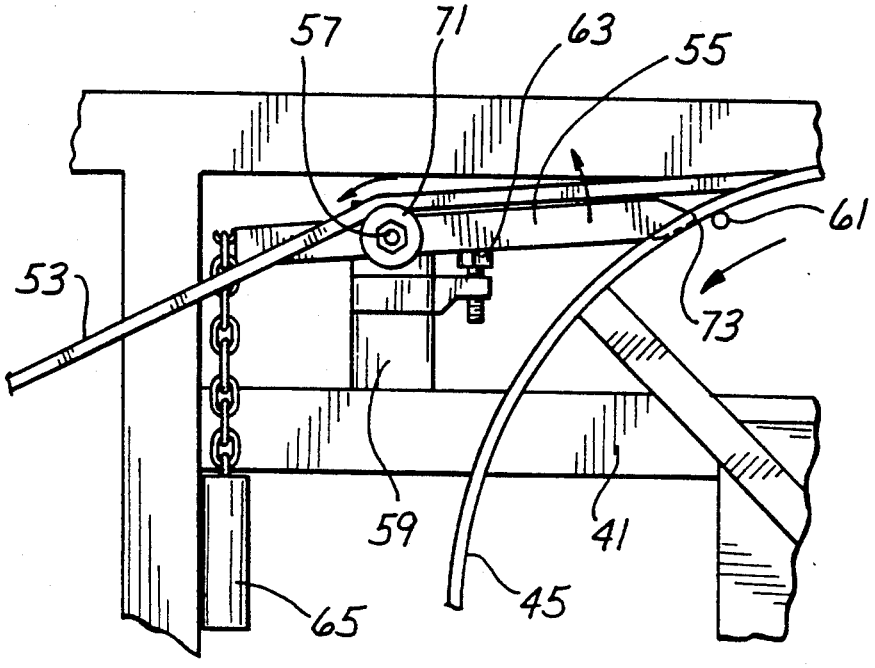
Fig. 6 PRIOR ART
FIG. 6 is an enlarged fragmentary sectional view similar to FIG. 5 illustrating a prior art construction for moving the locking member to the releasing position.

The prior art technique for moving the locking member 55 from the locking position to the releasing position is illustrated in FIG. 6. In the prior art construction, a pulley 71 is affixed to the pin 57 and the belt 53 passes over the pulley. Consequently, when the motor 51 is energized, the belt 53 drives the pulley 71 counterclockwise as viewed in FIG. 6 to pivot the locking member 55 from the locking position to the releasing position. For this system to function properly, it is necessary that the locking member 55 release the drive wheel 45 for rotation in the gate opening direction before the drive wheel is rotated in this direction to bring the stop 61 into hard frictional engagement with the locking member 55. To reduce the likelihood of this occurring, in the prior art device of FIG. 6, the stop 61 is spaced slightly, i.e. 3/16 to ¼ inch, from the end of the locking member 55 in the locking position. In addition, the locking member 55 has an end 73 which is pointed. Consequently, even slight movement of the locking member 55 toward the releasing position should be sufficient to avoid hard contact between the locking member and the stop 61 of the type that would cause the drive wheel 45 to hang up. Unfortunately, however, stretching of the belt 53 during use makes these provisions inadequate, at least in some cases, to prevent the drive wheel 45 from being released. Also, unauthorized entry can sometimes occur.

The present invention eliminates the pulley 71 and the belt drive arrangement for the locking member 55. A second motor which, in this embodiment, is a linear solenoid 75 (FIG. 5) is employed to move the locking member 55 from the locking position to the releasing position. In this embodiment, the solenoid 75 is mounted on one of the frame members 41 and includes or is coupled to an arm 77 which is attached to the locking member 55.

The solenoid 75 can be actuated to move the locking member 55 from the locking position to the releasing position. When the solenoid is de-energized after a predetermined short delay, an internal return spring (not shown) of the solenoid returns the locking member 55 to the locking position. The solenoid 75 can be energized simultaneously with the energization of the motor 51, and it will act quickly enough to move the locking member to the releasing position before the drive wheel 45 has time to rotate sufficiently to cause hang up of the drive wheel. However, because the solenoid 75 is separate from the motor 51, it can be energized slightly ahead of the motor 51, if desired.

Preferably, the pointed end 73 of the prior art is replaced with a generally flat end surface 79. This provides a longer area for locking contact with the stop 61 if the gate is used to back drive the drive wheel 45. This provides a more reliable lock than does the pointed end 73 of the prior art construction of FIG. 6. This invention also preferably employs a slight space, e.g. 3/16 inch between the stop 61 and the flat end surface 79.

Means is provided for generating a gate opening signal, and in this embodiment, such means includes a push button digital input 91 (FIG. 1) mounted on the supporting structure 15. This signal generating means may, however, be of any suitable kind and may include, for example, a remote push button system, a key card reader system, intercom telephone system, air hose switch, ground loop sensory system, hand-held transmitter, etc.

Means, such as suitable electrical circuitry 93 (FIG. 1) is responsive to the gate opening signal to energize the motor 51 and the solenoid 75. Both the signal generating means and the circuitry which responds to the gate opening signal may be conventional. The electrical power for operating the motor 51 and the solenoid 75 may be obtained from a utility company, batteries, or a solar panel.

Preferably, one or more coil springs 95 is drivingly coupled to the mounting post 25 and to one of the end posts 33. The arrangement is such that the spring 95 generates sufficient force to move the gate 13 to approximately a 45 degree position with respect to the horizontal if no other forces are acting on the gate. Thus, when the gate opening signal is received and the drive wheel 45 is unlocked, energization of the motor 51 allows the spring 95 to raise the gate to about the 45 degree position. From the 45 degree position to the 90 degree position, i.e. to the vertical position, the motor 51 cooperates with the spring 95 to provide the necessary driving force.

The gate 13 may be returned to the closed position after a time delay or in response to a signal from any of the signal generating means identified above. The motor 51 is counter-rotated by the circuitry 93 in a known manner in response to the gate closing signal.

During about the first 45 degrees of closing movement of the gate, i.e. from about 90 degrees to about 45 degrees, the spring 95 retards the tendency of the gate to fall under the influence of gravity to the closed position and the motor 51 acts like a brake. To move the gate from the 45 degree position to the 0 degree position, the motor 51 drives the gate downwardly to the closed position against the biasing action of the spring 95.

Figure 7:
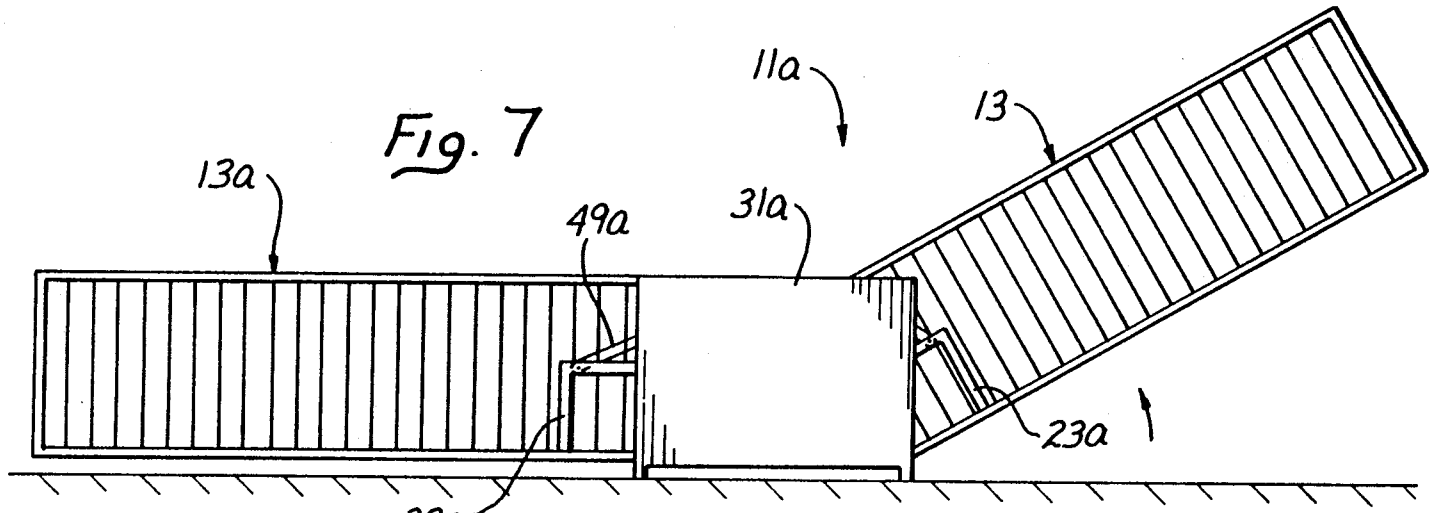
FIG. 7 is a front elevational view of a security gate system including two vertically movable gates with the right hand gate being moved toward the open position.
Figure 8:
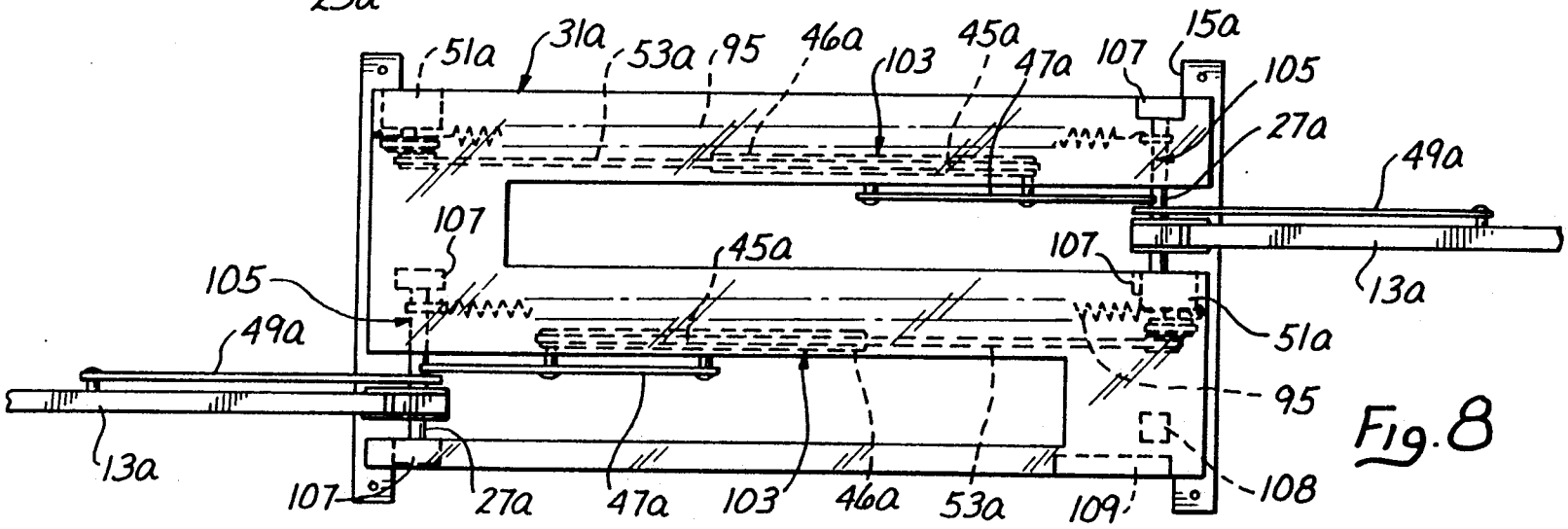
FIG. 8 is a fragmentary top plan view of a central portion of the security gate system of FIG. 7.

FIG. 7 and 8 show a security gate system **11*a* which is identical to the security gate system 11 in all respects not shown or described herein. Portions of the security gate system 11*a* corresponding to portions of the security gate system 11** are designated by corresponding reference numerals followed by the letter a.

As shown in FIG. 8, the housing **31*a* has oppositely directed openings or recesses 101 for receiving the gates 13*a*. The housing 31*a* includes and/or encloses a suitable supporting structure for the gate system 11*a*. The gates extend in opposite directions from the housing. An operating mechanism 103 is provided for each of the gates. Each of the operating mechanisms 103 includes a drive wheel 45*a*, a lever 47*a*, a link 49*a*, a motor 51*a*, all of the drive components from the motor 51*a* to the drive wheel 45*a* and all of the components shown in FIGS. 1–6 utilized to lock and release the drive wheel and the springs 95. Separate mounting structures 105 are provided for mounting the gates 13*a* for pivotable movement about first and second generally spaced, horizontal pivot axes between the open and closed positions. Each of the mounting structures 105 include a pin or shaft 27*a* and bearings 107 mounted on the supporting structure. The bearings 107 support the shafts 27*a* for rotation. As shown near the right end of FIG. 8, the motor 51*a* overlaps the bearing 107 and further helps achieve compactness in the width dimension of the housing 31*a***.

A battery 108 and a single control panel 109, which includes all of the controls for the motors **51*a* and the solenoids, is suitably maintained within the housing 31***a* on the supporting structure. Only one control panel 109 and one battery 108 are required for both of the gates 13*a*. The battery 108 provides power for the motors 51*a* and the solenoids.

The security gate system 11*a* operates in the same manner as described above for the security gate system 11.

Although exemplary embodiments of the invention have been shown and described, many changes, modifications and substitutions may be made by one having ordinary skill in the art without necessarily departing from the spirit and scope of this invention.

I claim:

1. In a security gate system which includes a supporting structure, a gate mounted on the supporting structure for pivotal movement about a generally horizontal pivot axis between a closed position in which the gate can block traffic along a predetermined route and an open position in which the gate is pivoted upwardly from the closed position to allow traffic to move along the predetermined route, a drive wheel rotatably mounted on the supporting structure and drivingly coupled to the gate such that rotation of the drive wheel in a gate opening direction drives the gate from the closed position to the open position, a first motor drivingly coupled to the drive wheel to rotate the drive wheel in the gate opening direction, a releasable lock for releasably holding the drive wheel against significant rotation in the gate opening direction whereby the gate is held in the closed position, said releasable lock including a stop carried by the drive wheel and a locking member having an end surface, said locking member being pivotable about a pivot axis between a locking position in which the end surface is cooperable with the stop to hold the drive wheel against significant rotation in the gate raising direction and a releasing position in which the drive wheel can be driven in the gate opening direction to move the gate to said open position, the improvement comprising an arm coupled to the locking member between the pivot axis and the end surface of the locking member and a linear solenoid for driving the arm to move said locking member from the locking position to the releasing position.

2. A security gate system as defined in claim 1 wherein the solenoid moves the locking member from the releasing position to the locking position.

3. A security gate system as defined in claim 1 including means for generating a gate opening signal and means responsive to the gate opening signal to energize the first motor and the solenoid.

4. A security gate system as defined in claim 1 wherein the end surface of the locking member is generally flat.

5. A security gate system comprising:

a supporting structure;

a housing substantially enclosing the supporting structure;

first and second security gates extending in opposite directions from the housing, each of the gates including a peripheral frame;

first and second mounting structures for mounting the first and second gates on the supporting structure for pivotal movement about first and second generally horizontal pivot axes, respectively, said first and second gates being pivotable about the associated pivot axes between a closed position in which the first and second gates can block traffic along first and second predetermined routes respectively and an open position in which the gates are pivoted upwardly from the closed position to allow traffic to move along the first and second predetermined routes;

first and second operating mechanism for moving the first and second gates respectively, between the open and closed positions;

said mounting structures and said operating mechanism being at least substantially within said housing; and a component of the mounting structure or the operating mechanism for the first gate overlapping as viewed from above a component of the mounting structure or the operating mechanism for the second gate whereby compactness in a dimension of the housing is achieved.

6. A security gate system as defined in claim 5 wherein a component of the mounting structure for the first gate overlaps as viewed from above a component of the operating mechanism for the second gate.

7. A security gate system as defined in claim 6 including a single battery within said housing for providing power to both of said first and second operating mechanism and a single control panel in said housing, said control panel including controls for the first and second operating mechanisms in said housing.

8. A security gate system as defined in claim 5 including a single battery within said housing for providing power to both of said first and second operating mechanisms.

9. A security gate system as defined in claim 5 including a single control panel in said housing, said control panel including controls for the first and second operating mechanisms in said housing.

10. A security gate system as defined in claim 5 wherein each of the first and second operating mechanisms includes a locking member for holding the associated gate in the closed position and a solenoid for moving the locking member to a releasing position in which the associated gate can be moved to the open position.

* * * * *